US005718249A

United States Patent [19]

Suzuki et al.

[11] Patent Number: 5,718,249

[45] Date of Patent: Feb. 17, 1998

[54] SHREDDED TOBACCO SUPPLYING APPARATUS FOR A CIGARETTE MANUFACTURING MACHINE

[75] Inventors: Takehiro Suzuki; Tomio Orihara, both of Tokyo, Japan

[73] Assignee: Japan Tobacco, Inc., Tokyo, Japan

[21] Appl. No.: 800,679

[22] Filed: Feb. 14, 1997

Related U.S. Application Data

[63] Continuation of Ser. No. 602,376, Feb. 16, 1996, abandoned.

[30] Foreign Application Priority Data

Feb. 16, 1995 [JP] Japan ..... 7-28503

[51] Int. Cl.[6] ..... A24C 5/14

[52] U.S. Cl. ..... 131/84.1; 131/84.2; 131/84.3

[58] Field of Search ..... 131/84.1, 84.4, 131/108, 905

[56] References Cited

U.S. PATENT DOCUMENTS

| | | | |
|---|---|---|---|
| 4,175,570 | 11/1979 | Heitmann | 131/84.1 |
| 4,564,027 | 1/1986 | Heitmann | 131/84.3 |
| 4,610,260 | 9/1986 | Heitmann | 131/84.3 |
| 4,785,830 | 11/1988 | Moller et al. | 131/84.1 X |
| 5,228,558 | 7/1993 | Hall | 198/575 |
| 5,494,053 | 2/1996 | Dawson et al. | 131/84.1 |

FOREIGN PATENT DOCUMENTS

| | | | |
|---|---|---|---|
| 2352502 | 12/1977 | France | 131/84.1 |
| 2584578 | 1/1987 | France | 131/84.1 |
| 3438371 | 5/1985 | Germany | 131/84.1 |
| 62-65673 | 3/1987 | Japan | 131/84.1 |
| 2133965 | 8/1984 | United Kingdom | 131/84.1 |
| 2179840 | 3/1987 | United Kingdom | 131/84.1 |
| 2208585 | 12/1989 | United Kingdom | 131/84.1 |
| 2208586 | 12/1989 | United Kingdom | 131/84.1 |
| 2246945 | 2/1992 | United Kingdom | 131/84.1 |
| 91/11120 | 8/1991 | WIPO | 131/84.1 |

*Primary Examiner*—Vincent Millin
*Assistant Examiner*—Charles W. Anderson
*Attorney, Agent, or Firm*—Birch, Stewart, Kolasch, and Birch, LLP

[57] ABSTRACT

A shredded tobacco supplying apparatus for a cigarette manufacturing machine has a running speed sensor for detecting the belt running speed of a belt conveyor for conveying shredded tobacco, a blow fan for producing an air flow in a shredded tobacco supply passage extending toward the belt conveyor, and a main controller for driving the blow fan in accordance with the output of the running speed sensor. When the blow fan is driven, air is blown from the blow fan into the supply passage at a blowing velocity matching the belt running speed, by which air flow is produced. The shredded tobacco supplied to the supply passage is delivered to the conveyor belt by the air flow. At this time, a velocity component in the belt running direction, which is substantially equal to the belt running speed, is given to the shredded tobacco. Even when the belt is run at a high speed to increase the production volume of cigarettes, the difference in relative speed between the shredded tobacco and the belt of belt conveyor decreases, so that the attracting property of shredded tobacco to the belt surface is enhanced, by which the degradation in cigarette quality caused by the increase in belt running speed is prevented.

7 Claims, 8 Drawing Sheets

SHREDDED TOBACCO SUPPLYING APPARATUS FOR A CIGARETTE MANUFACTURING MACHINE

This application is a continuation of application Ser. No. 08/602,376, filed on Feb. 16, 1996, now abandoned the entire contents of which are hereby incorporated by reference.

BACKGROUND OF THE INVENTION

1. Field of the Invention

The present invention relates to a cigarette manufacturing machine and, more particularly, to an apparatus for supplying shredded tobacco to a conveyor belt used for conveying shredded tobacco onto a paper.

2. Description of Related Arts

A cigarette manufacturing machine consists mainly of a shredded tobacco supplying apparatus and a wrapping apparatus. The supplying apparatus comprises a belt conveyor for conveying shredded tobacco to the wrapping apparatus and a supply passage for introducing shredded tobacco with air flow to the belt conveyor. The belt (tobacco band) of the belt conveyor has a mesh structure having a plurality of tiny holes. This supplying apparatus applies an attracting force to shredded tobacco via the tiny holes to attract shredded tobacco to the belt surface.

The shredded tobacco coming out of the supply passage is attracted in layers to the running tobacco band and conveyed in the band running direction. The shredded tobacco reaching the terminal end of the belt conveyor is supplied onto a paper running in the wrapping apparatus and formed into a cigarette rod by being enveloped in the paper. Afterward, the cigarette rod is cut into individual cigarettes.

The cigarette manufacturing machine is required to produce large quantities of cigarettes. In order to increase the amount of shredded tobacco conveyed to the wrapping apparatus by the belt conveyor to meet this requirement, the amount of shredded tobacco supplied from the supply passage to the belt conveyor must be increased. If the supply amount of shredded tobacco is small, the amount per unit time of shredded tobacco conveyed from the supply passage to the wrapping apparatus via the belt conveyor decreases. As a result, the shredded tobacco put in a cigarette rod formed by the wrapping apparatus runs short, so that a good quality of cigarette rod cannot be achieved.

In order to increase the supply amount of shredded tobacco, firstly, the flow velocity of air and shredded tobacco in the supply passage is required to be increased, and secondly, the attracting property of shredded tobacco to the tobacco band is required to be enhanced.

For example, Unexamined Japanese Patent Publication No. 62-65673 discloses a cigarette manufacturing machine having a means for meeting the above second requirement. This known means of the cigarette manufacturing machine is provided with louvers (straightening vanes) arranged near the outlet of supply passage. The louvers serve to deflect the flow of shredded tobacco at the outlet of supply passage and to give the shredded tobacco a velocity component in the belt running direction while the shredded tobacco moves toward the tobacco band. If the velocity component in the belt running direction given to the shredded tobacco is approximately equal to the belt running speed, the attracting property of shredded tobacco to the belt (tobacco band) is enhanced.

If the belt running speed (the transfer speed of shredded tobacco conveyed by the conveyor) is increased and the flow velocity of shredded tobacco in the supply passage is increased extremely to further increase the production capacity of the cigarette manufacturing machine, the flow of shredded tobacco cannot be deflected suddenly even if louvers are arranged at the outlet of supply passage. That is to say, in the cigarette manufacturing machine having a supply passage extending from the lateral side of belt conveyor toward the start end of belt conveyor, it is difficult in some case to give the shredded tobacco a velocity component in the belt running direction approximately equal to the belt running speed by means of the louvers arranged at the outlet of supply passage. In this case, when the shredded tobacco reaches the belt conveyor from the supply passage, part of the shredded tobacco collides with the tobacco band and is repelled. As a result, the amount of shredded tobacco attracted to the tobacco band, and in turn, the amount of shredded tobacco conveyed by the belt conveyor run short, so that the filling density of shredded tobacco in a cigarette rod decreases, by which the quality of cigarettes may be degraded.

Also, if the velocity component of shredded tobacco in the belt running direction differs greatly from the belt running speed, most shredded tobacco is attracted to the belt surface after rolling and moving on the belt surface. In this case, the position where the shredded tobacco is attracted to the tobacco band shifts from the initially intended position, so that the shredded tobacco is not attracted to the tobacco band in uniform layers. As a result, the filling density of shredded tobacco in a cigarette rod varies.

Even in the cigarette manufacturing machine having the supply passage extending along the longitudinal axis of belt conveyor, if the velocity component of shredded tobacco in the belt running direction differs greatly from the belt running speed, the attracting property of shredded tobacco to the tobacco band decreases, or the shredded tobacco is attracted nonuniformly to the tobacco band, so that the quality of cigarettes may be degraded.

SUMMARY OF THE INVENTION

An object of the present invention is to provide a shredded tobacco supplying apparatus for a cigarette manufacturing machine, in which even when a belt conveyor is run at a high speed to increase the production capacity of cigarette manufacturing machine, shredded tobacco of a required amount can be attracted to the belt conveyor, by which the degradation in cigarette quality can be prevented.

According to the present invention, there is provided a shredded tobacco supplying apparatus for a cigarette manufacturing machine, which continuously manufactures a cigarette rod by enveloping shredded tobacco supplied onto a paper in the paper.

The shredded tobacco supplying apparatus comprises a conveyor, having a belt with a surface to which shredded tobacco can be attracted, for conveying shredded tobacco, attracted in layers to the belt surface, to the paper by running the belt; air-supplying means, having a supply passage extending below the conveyor toward the belt surface, for producing an air flow by blowing air from at least one air blowing region provided in the supply passage into the supply passage and for supplying the shredded tobacco toward the belt surface by using the air flow; running speed detecting means for detecting the running speed of the belt; and blowing velocity control means for driving the air-supplying means so that the blowing velocity of air from the air blowing region changes in accordance with the belt running speed detected by the running speed detecting means.

According to the present invention, the blowing velocity of air blown from the air blowing region of supply passage toward the belt surface can be changed in accordance with the belt running speed, and a velocity component in the belt running direction matching the belt running speed can be given to the shredded tobacco. For this reason, regardless of the belt running speed, especially even when the belt is run at a high speed, the difference in relative speed between the shredded tobacco and the belt can be decreased. Therefore, the density of shredded tobacco repelled by the belt surface can be reduced significantly, and the rolling of shredded tobacco on the belt surface can be restricted. Consequently, shredded tobacco of a required amount can always be attracted to the belt surface uniformly, so that the filling density of shredded tobacco in cigarette can be improved, by which a good quality of cigarettes can be maintained stably.

Preferably, the air-supplying means has a supply surface defining one side of the supply passage, and the supply surface is curved upward in a concave form. In this case, the length of supply passage can be decreased. Also, while the shredded tobacco is delivered with air along the supply surface, the vertically upward velocity component of shredded tobacco increases gradually. As a result, the attracting property of shredded tobacco to the belt surface is enhanced.

Preferably, the supply passage of the air-supplying means extends from the lateral side of the conveyor toward the belt surface, and the air-supplying means blows air into the supply passage in the direction inclined at a predetermined angle toward the terminal end side of the conveyor with respect to the longitudinal axis of the belt, on the plan view, in the air blowing region. In this case, a velocity component in the belt running direction matching the belt running speed can be given to the shredded tobacco by the air blown in the inclined direction. As a result, the attracting property of shredded tobacco to the belt surface is enhanced.

Preferably, the blowing velocity control means drives the air-supplying means so that the blowing velocity of the air changes in such a manner that the velocity component in the belt running direction given to the shredded tobacco by the air follows the belt running speed. In this case, the velocity component of shredded tobacco in the belt running direction is substantially equal to the belt running speed, so that the shredded tobacco is always attracted to the belt surface properly.

Preferably, the air-supplying means changes the predetermined angle in accordance with the belt running speed. In this case, the air blowing angle, and in turn, the velocity component of shredded tobacco in the belt running direction can match the belt running speed, so that the attracting property of shredded tobacco to the belt surface is enhanced.

Preferably, the supplying apparatus further comprises attracting means for producing an attracting force for attracting the shredded tobacco to the belt surface, and the attracting means changes the attracting force in accordance with the blowing velocity of the air. In this case, the force for attracting the shredded tobacco produced by the attracting means can match the air blowing velocity, so that the shredded tobacco is attracted to the belt surface properly and stably.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
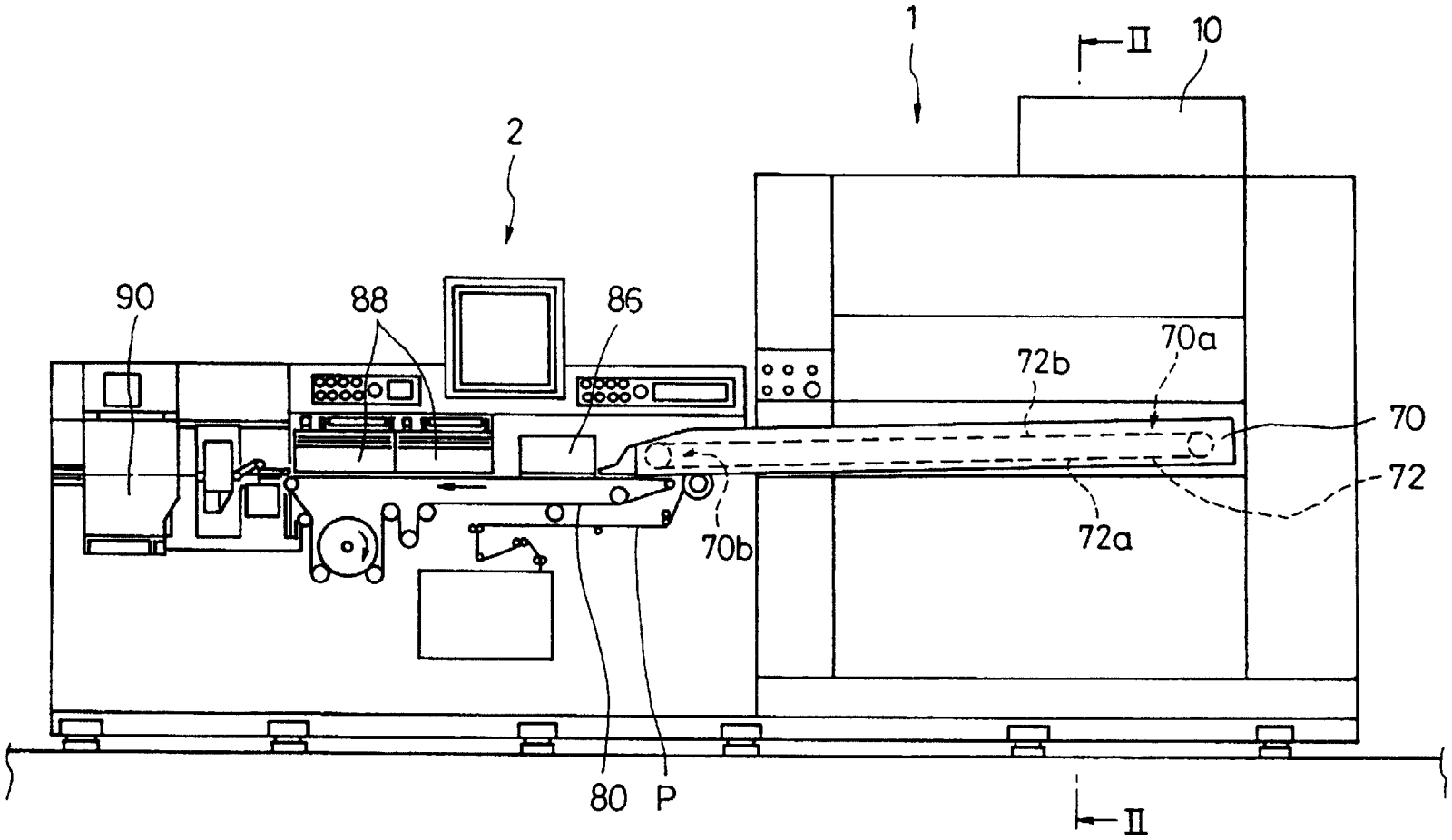
FIG. 1 is a schematic front view of a shredded tobacco supplying apparatus and a wrapping machine of a cigarette manufacturing machine.

Referring to FIG. 1, a cigarette manufacturing machine comprises a shredded tobacco supplying apparatus 1 and a wrapping machine 2 adjacent to the left side of the shredded tobacco supplying apparatus 1.

The supplying apparatus 1 has a supply port 10 at the upper part thereof. Shredded tobacco T is fed through this supply port 10. The size of the fed shredded tobacco T is made uniform within the supplying apparatus 1. The supplying apparatus 1 also has an attracting type belt conveyor 70. The belt conveyor 70 has an endless tobacco band (conveyor belt) 72 passing around a driving roller and a driven roller and extending horizontally between the start end 70*a* and the terminal end 70*b* of the conveyor 70. The tobacco band 72 is run by rotating the driving roller by using a motor (denoted by reference numeral 7 in FIG. 3). The tobacco band 72 runs from the start end 70*a* to the terminal end 70*b* of the conveyor 70 on the lower side of roller, and runs in the opposite direction on the upper side of roller (hereinafter called a lower tobacco band 72*a* and an upper tobacco band 72*b* for convenience of explanation (see FIGS. 1 and 3)). The supplying apparatus 1 is designed so that shredded tobacco T is attracted in layers to the lower surface (hereinafter called a belt surface) of the lower tobacco band 72*a*, and the shredded tobacco T attracted to the belt surface is conveyed to the wrapping machine 2 by running the tobacco band 72 and supplied onto a paper P prepared in the wrapping machine 2.

The wrapping machine 2 comprises a wrapping apparatus 86 including a pasting device, a drying apparatus 88, a cutting apparatus 90, and a garniture belt 80 running at a high speed. The garniture belt 80 passes, with the paper P placed thereon, through the wrapping apparatus 86, where the shredded tobacco on the paper P is enveloped in the paper P to form a cigarette rod. More specifically, the paper P together with the garniture belt 80 is first formed into a U shape in the wrapping apparatus 86, and the pasting device applies paste to one side edge of paper P. Subsequently, both the side edges of the U-shaped paper P are bent successively and pasted to each other to form a cigarette rod. The pasted portion of the cigarette rod is dried when the cigarette rod passes through the drying apparatus 88, and the cigarette rod is cut into individual cigarettes when it passes through the cutting apparatus 90. The detailed explanation of the wrapping machine 2 is omitted here because it is publicly known.

The cigarette manufacturing machine is adapted so that the production volume of cigarettes can be changed appropriately in a stepwise or continuous mode. The maximum production volume per unit time (1 min), that is, the production capacity is, for example, 16,000 (pieces/min), two times of the typical production volume of the conventional machine.

Figure 2:
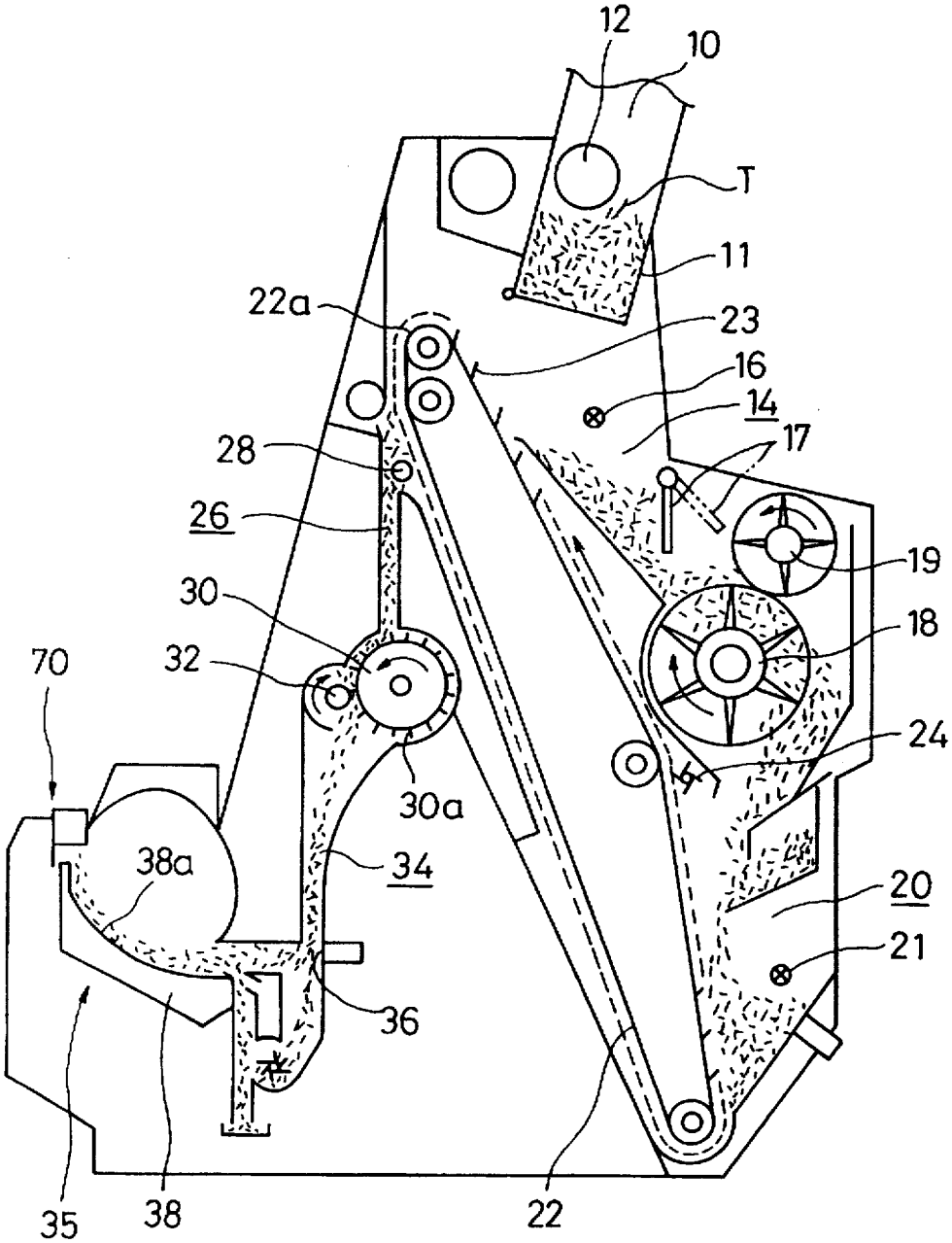
FIG. 2 is a longitudinal sectional view of the shredded tobacco supplying apparatus, taken along the line II—II of FIG. 1.

Referring now to FIG. 2, a sluice mechanism 11 for storing the shredded tobacco T is formed at the lower end of the supply port 10 of the supplying apparatus 1, and a feed pipe 12 extends from the sluice mechanism 11 into a distributor 14. The feed pipe 12 is connected to an air-supplying device. This air-supplying device is operated in accordance with the amount of shredded tobacco T stored in the distributor 14, and supplies, with air, the shredded tobacco T in the sluice mechanism 11 appropriately into the distributor 14 through the feed pipe 12. In this embodiment, the amount of shredded tobacco T stored in the distributor 14 is detected by using a photoelectric sensor 16 or the like. Based on the stored amount thus detected, the operation control of the air-supplying device is carried out to supply shredded tobacco T into the distributor 14.

The shredded tobacco T stored in the distributor 14 is sent to a storage 20 while being disentangled by a feed roller 18 with vanes and an auxiliary roller 19 disposed in parallel to the feed roller 18 so as to rotate in the direction opposite to that of the feed roller 18. The storage 20 is also provided with a photoelectric sensor 21, which is similar to the aforementioned photoelectric sensor 16. The photoelectric sensor 21 detects the amount of shredded tobacco T stored in the storage 20, by which the operation of the feed roller 18 and the auxiliary roller 19 is controlled. Thereupon, the amount of shredded tobacco T supplied to the storage 20 is regulated. On the upstream side of the feed roller 18, a shutoff flap 17 is installed rotatably. This shutoff flap 17 serves to regulate the flow rate of shredded tobacco T so that the feed roller 18 and the auxiliary roller 19 can operate smoothly.

A finned conveyor 22 extends upward from the lower end of the storage 20. The shredded tobacco T stored in the storage 20 is scraped up in the arrow-marked direction by the finned conveyor 22. The finned conveyor 22 has many fins 23 installed on the endless conveyor belt, and fins 23 are positioned at constant intervals in the lengthwise direction and extend in the width direction of the conveyor belt. The finned conveyor 22 is driven by a motor (not shown).

The running speed of the finned conveyor 22 is changed according to the production volume of cigarettes, that is, the running speed $V_C$ of the belt (tobacco band) of the belt conveyor 70. Since the heights and installation intervals of all fins 23 on the conveyor 22 are constant, the amount per unit time of shredded tobacco T scraped up by the conveyor 22 is always constant as long as the conveyor 22 is run at the same speed. A paddle roller 24 extending in parallel to the width direction of the conveyor 22 is installed near the finned conveyor 22. This paddle roller 24 serves to throw off the shredded tobacco T scraped up while projecting from the tip end of the fin 23. Thereby, the amount of shredded tobacco T scraped up by one fin 23 is made uniform.

The shredded tobacco T scraped up in constant amounts by the finned conveyor 22 is, after passing through the top of the conveyor 22, released from the finned conveyor 22 by gravity, and moves downward into a first chute 26. At the intermediate part of the first chute 26 is installed a spread roller 28, which serves to spread the shredded tobacco T into a uniform layer thickness in the width direction of the first chute 26.

At the lower end of the first chute 26, a needle roller 30 and a picker roller 32 are disposed so as to be in parallel to each other. These two rollers 30 and 32 are rotated in the opposite directions to each other and deliver, in cooperation, the shredded tobacco T from the first chute 26 to a second chute 34. Many needles **30*a* protrude radially on the outer peripheral surface of the needle roller 30. The shredded tobacco T entangled by moisture and the like is forcedly disentangled by the needles 30*a* when passing between the needle roller 30 and the picker roller 32**.

The shredded tobacco which has passed between the needle roller 30 and the picker roller 32 drops by gravity into the second chute 34. The shredded tobacco T dropping in the second chute 34 flows from the second chute into a shredded tobacco supply passage (accelerating region) 35. The supply passage 35 extends from the lateral side of the second chute 34 to the belt surface at the lower part of the belt conveyor 70.

The shredded tobacco T flowing into the accelerating region 35 is introduced onto a bed 38 of the accelerating region 35 by high-speed blow air blown from an air blowing opening 36 provided in a first air blowing region of the passage 35. That is to say, at the entrance of the accelerating region 35, the supply direction of shredded tobacco T is changed from vertical downward direction to the substantially horizontal left direction as shown in FIGS. 2 and 3, and the shredded tobacco T is strongly blown onto an accelerating surface **38*a* of the bed 38**.

The air blowing opening 36 is positioned below the second chute 34, and connected to a discharge port of a blow fan (denoted by reference numeral 64 in FIG. 3) via an air line (denoted by reference numeral 100 in FIG. 3). The flow velocity $V_a$ of air injected from the air blowing opening 36 is regulated according to the production volume of cigarettes as with the finned conveyor 22, the details of which will be described later.

Figure 3:
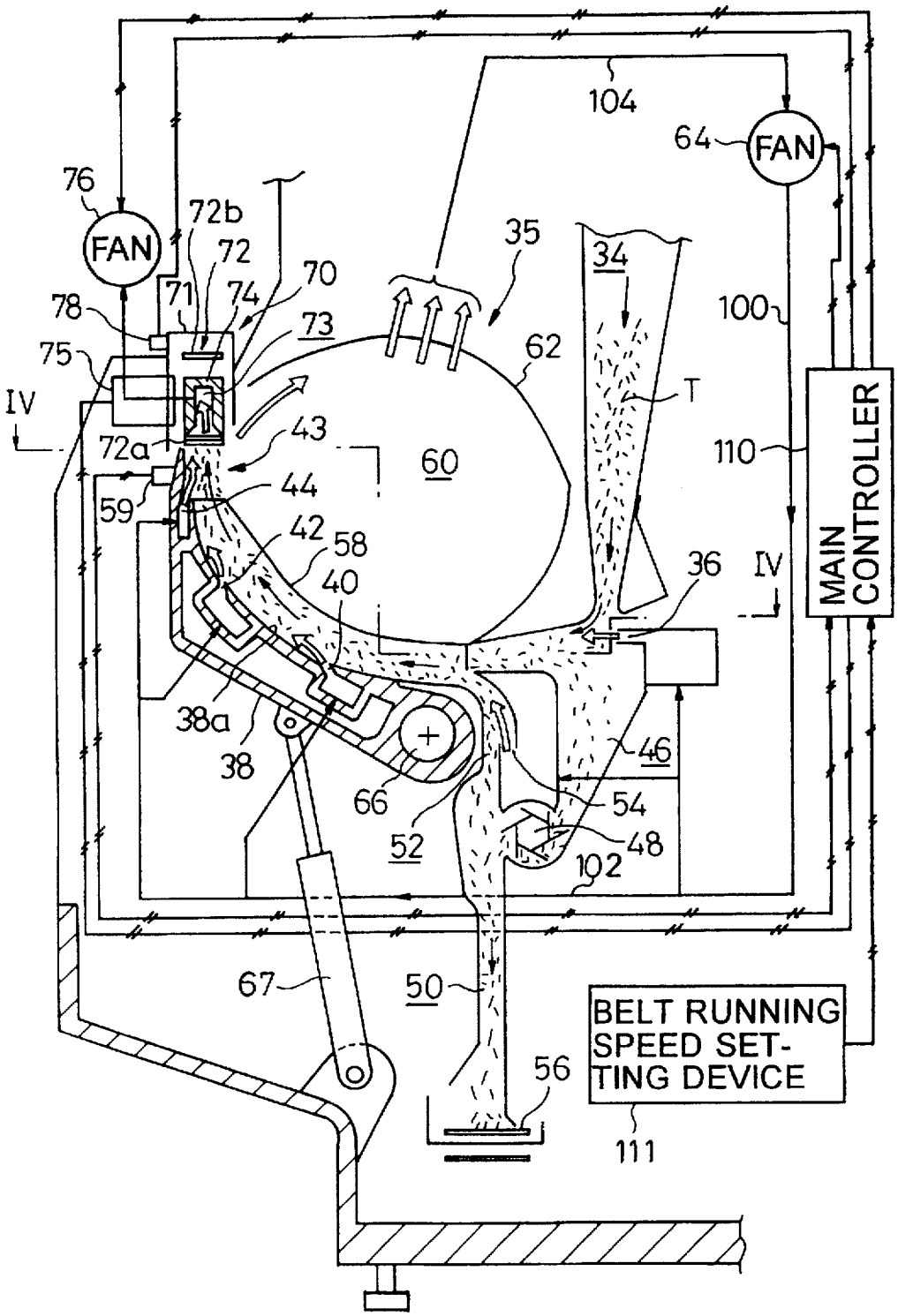
FIG. 3 is an enlarged view showing in detail an accelerating region of the shredded tobacco supplying apparatus shown in FIG. 2.

Referring now to FIG. 3, the details of the accelerating region 35 are shown. The accelerating region 35 will be described below with reference to FIG. 3. In FIG. 3, an outline type arrow indicates the flow of air and a solid line arrow indicates the flow of shredded tobacco T.

The accelerating surface (supply surface) **38*a* of the bed 38 is curved upward in a concave form toward the belt surface. The shredded tobacco T blown in the horizontal direction by air injected from the air blowing opening 36** flows with air along the accelerating surface 38*a* of the bed 38 while being pushed against the accelerating surface 38*a*. Finally, the flow direction of shredded tobacco T is changed to the upward direction, and the shredded tobacco T is discharged from the upper end of the accelerating surface 38*a*, that is, an discharge port 43 of the supply passage 35. The discharge port 43 is open upward, and the aforementioned tobacco band 72 of the belt conveyor 70 extends above the discharge port 43.

In a second, third, and fourth air blowing regions of the supply passage 35, air blowing openings 40, 42, and 44 are provided toward the flow direction of shredded tobacco T in the bed 38. These air blowing openings 40, 42, and 44 are connected to the aforementioned blow fan 64 via the air line 100. The air blowing openings 40, 42, and 44 are arranged at intervals sequentially from the upstream side, viewed in the flow direction of shredded tobacco T (the direction perpendicular to the longitudinal axis of the tobacco band 72). The air blowing opening 44 is positioned at the same height as that of the upper end of the bed 38, that is, the discharge port 43, and blows air toward the tobacco band 72 of the belt conveyor 70.

From the air blowing openings 40, 42, and 44, like the air blowing opening 36, high-speed air of blowing velocity $V_a$ supplied from the blow fan 64 is blown, by which the shredded tobacco T is accelerated and discharged through the discharge port 43.

More specifically, the shredded tobacco T supplied onto the bed 38 by the air injected from the air blowing opening 36 is accelerated in sequence by the air blown from the air blowing openings 40, 42, and 44, and finally discharged from the discharge port 43.

On the accelerating surface 38*a* of the bed 38 are erected a pair of sideboards (side guide plates) 58. The accelerating surface 38*a* and the pair of sideboards 58 constitute the main portion of the shredded tobacco supply passage 35. The pair of sideboards 58 will be further described later.

At the tip end of the bed 38, an airflow sensor 59 is installed in the vicinity of the discharge port 43. This airflow sensor 59, which is, for example, a Pitot tube type sensor, detects the flow rate of air and supplies the detection signal to a main controller 110, described later.

The lower end of the bed 38 is pivotally supported by a pin 66. The bed 38 and the housing 1*a* of the supplying apparatus 1 are connected to each other via an air cylinder 67. When a piston rod of the air cylinder 67 is retracted from the state shown in FIG. 3 into the air cylinder body, the bed 38 is turned downward with the pin 66 being the center. This allows access to the above-described supply passage 35, especially to the accelerating surface 38, which is convenient for maintenance.

Of the shredded tobacco T discharged from the lower end of the second chute 34, large shredded tobacco T, that is, heavy shredded tobacco T is not blown horizontally even by the injection of air from the air blowing opening 36, and drops into a third chute 46 disposed below the second chute 34. A roller 48 with vanes is installed at the lower end of the third chute 46, the lower end opening of the third chute 46 is connected to the upper end of a fourth chute 50, and a recovery conveyor 56 is provided just below the lower end opening of the fourth chute 50. The recovery conveyor 56 is connected to the supply port 10, and a shredding device (not shown) is interposed on the way to the supply port 10.

The shredded tobacco T which has dropped in the third chute 46 is sent to the fourth chute 50 by means of the roller 48 with vanes. Especially heavy shredded tobacco T further drops in the fourth chute 50, and is deposited on the recovery conveyor 56. The shredded tobacco T deposited on the recovery conveyor 56 is conveyed to the shredding device, where the shredded tobacco T is shredded again into a proper size, and then supplied to the supply port 10.

On the other hand, a throat 52 extends from the upper part of the fourth chute 50. This throat 52 is open to the start end of the accelerating surface 38*a* of the bed 38. At the intermediate part (a fifth air blowing region of the shredded tobacco supply passage 35) of the throat 52 is provided an air blowing opening 54. The air blowing opening 54, which is connected to the blow fan 64 via the air line 100, can blow high-speed air of blowing velocity $V_a$ supplied from the blow fan 64 in the upward direction, that is, toward the accelerating surface 38*a*. Thereby, relatively small and lightweight shredded tobacco T of the shredded tobacco T delivered into the fourth chute 50 by the roller 48 with vanes is attracted and raised by the air blown from the air blowing opening 54, and introduced to the accelerating surface 38*a* of the bed 38 through the throat 52. Therefore, of the shredded tobacco T which has dropped in the third chute 46, relatively lightweight shredded tobacco T joins the shredded tobacco T directly blown onto the accelerating surface 38*a* by the aforementioned air blowing opening 36, is supplied, with air, onto the accelerating surface 38*a* of the bed 38, and is discharged through the discharge port 43.

Thus, the shredded tobacco T blown at a high velocity from the discharge port 43 of the bed 38 is blown to the tobacco band 72 of the above-described shredded tobacco attracting type belt conveyor 70.

The belt conveyor 70 is driven at a high speed by the drive motor 75. This drive motor 75 is connected to the main controller 110. On a cover 71 of the belt conveyor 70, a running speed sensor (running speed detecting means) 78 is installed. This running speed sensor 78 detects the running speed $V_C$ of the belt of the belt conveyor 70, and supplies the signal indicative of the detected belt running speed to the main controller 110.

The tobacco band 72 is of a mesh configuration, for example, with fibers being woven. On the surface of the tobacco band 72 are provided many tiny holes penetrating to the back surface, though the shredded tobacco cannot pass through these holes. On the back surface side of the tobacco band 72, a suction cover 74 forming a suction chamber 73 is provided. The suction chamber 73 is in communication with a suction fan 76. The suction cover 74 extends along the tobacco band 72 so as to abut on the back surface of the tobacco band 72. Therefore, the shredded tobacco T blown from the discharge port 43 is attracted in layers to the surface of the tobacco band 72 by an attracting force produced in the suction chamber 73.

The suction fan 76 is, like the blow fan 64, connected to the main controller 110.

As shown in FIG. 3, above the bed 38 is provided a filter casing 62, which extends arcuately from the suction cover 74 to the start end of the bed 38. This filter casing 62 defines a chamber 60 which is in communication with the shredded tobacco supply passage 35. The filter casing 62 has a region in which many tiny holes of such a size that the shredded tobacco T cannot pass through are formed. This region is connected to a suction port of the aforementioned blow fan 64 via an air line 104.

Some shredded tobacco T which has flown into the chamber 60 without being attracted to the tobacco band 72 is returned onto the accelerating surface 38*a* of the bed 38. The air blown from the air blowing openings is returned to the suction port of the blow fan 64 through the tiny holes in the filter casing 62.

As described above, to the input side of the main controller denoted by reference numeral 110 in FIG. 3, the airflow sensor 59 and the running speed sensor 78 are connected, and a running speed setting device 111 for setting a target value of belt running speed and the like are also connected. To the main controller 110 are supplied output signals from these sensors. The running speed setting device 111 sets a target belt running speed by manual operation of an operator, or automatically sets a target belt running speed by receiving a command from a production instructing device (not shown) or the like. To the output side of the main controller 110, the blow fan 64, the drive motor 75, the suction fan 76, and the like are connected, as described above. The main controller 110 performs arithmetic operation, based on the output signals of the aforementioned various sensors, to carry out various controls such as air blowing velocity feedback control, describe later, and supplies a signal corresponding to the result of arithmetic operation to the output side.

As seen from FIG. 3, the tobacco band 72 runs at a high speed while maintaining a state in which the tobacco band 72 is positioned apart from the shredded tobacco discharge port 43 of the supply passage 35 in the height direction and faces to the discharge port 43. Therefore, if the shredded tobacco T is blown merely upward vertically, or in the direction perpendicular to the longitudinal axis of belt on the plan view, from the discharge port 43 to the tobacco band 72, some shredded tobacco T cannot follow the running speed (belt running speed) $V_C$ of the tobacco band 72, being repelled without being attracted to the tobacco band 72, because the shredded tobacco T have no velocity component $V_{THL}$ (see FIG. 9) in the running direction of the tobacco band (belt).

For this reason, in the supplying apparatus 1 of this embodiment, the directions of air blowing from the air blowing openings 36, 40, 42, 44, and 54 are inclined toward the terminal end side of the conveyor 70 (denoted by reference numeral **70*b* in FIG. 1) with respect to the horizontal axis perpendicular to the longitudinal axis of the belt 72, on the plan view, so as to give a velocity component $V_{THL}$ in the belt running direction to the shredded tobacco T in advance, by which the shredded tobacco T is attracted to the tobacco band 72** smoothly and reliably.

Figure 4:
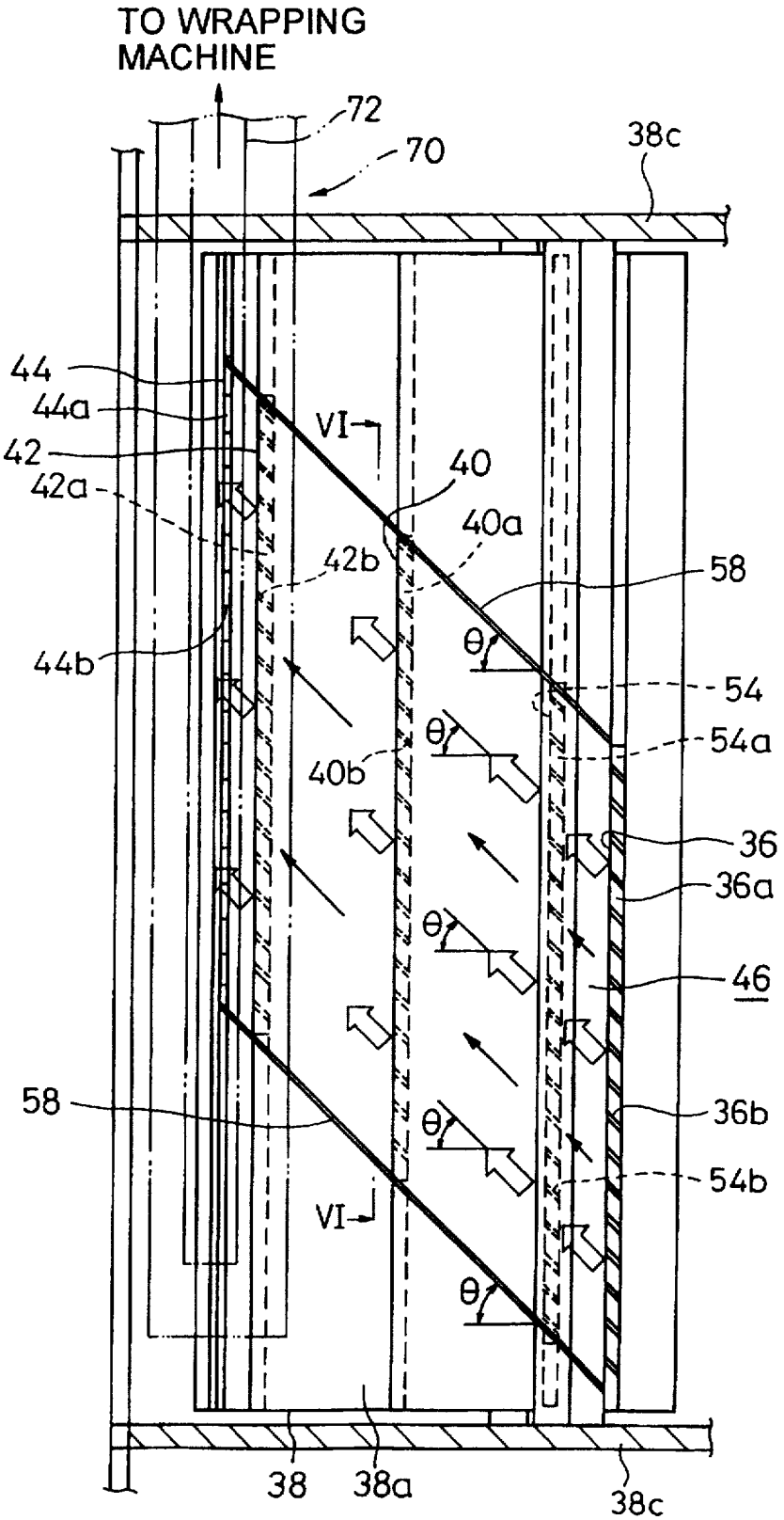
FIG. 4 is a transverse sectional view of the shredded tobacco supplying apparatus, taken along the line IV—IV of FIG. 3.

FIG. 4 shows the plane of the bed 38. As shown in this figure, on the accelerating surface **38*a* of the bed 38, the aforementioned pair of sideboards 58 are arranged in parallel to each other to define the shredded tobacco supply passage 35. These sideboards 58 are inclined at a predetermined angle θ (for example 45 deg) toward the terminal end side of the conveyor 70 with respect to the horizontal axis perpendicular to the longitudinal axis of the belt 72, on the plan view. Therefore, the flow direction of shredded tobacco T is regulated by the sideboards 58**.

As described above, the air blowing openings 36, 40, 42, 44, and 54 are provided in the first to fifth air blowing regions of the shredded tobacco supply passage 35. In the first to fifth air blowing regions, straightening plates (deflecting devices) **36*a*, 40*a*, 42*a*, 44*a*, and 54*a*, which extend in parallel to the longitudinal axis of the belt 72 between both side walls 38*c* of the bed 38, are provided so as to be aligned with the air blowing openings 36, 40, 42, 44, and 54. On the outside of the sideboards in the longitudinal direction of the belt 72, the air blowing openings 36, 40, 42, 44, and 54 are closed by the straightening plates 36*a*, 40*a*, 42*a*, 44*a*, and 54*a*, respectively. That is to say, the air blowing openings 36, 40, 42, 44, and 54 extend practically between the pair of sideboards 58**.

Each of the straightening plates **36*a*, 40*a*, 42*a*, 44*a*, and 54*a* is provided with many straightening fins (deflecting plates) 36*b*, 40*b*, 42*b*, 44*b*, and 54*b* formed at intervals in the longitudinal direction of the straightening plate to regulate the flow direction of air blown from corresponding one of the air blowing openings 36, 40, 42, 44, and 54. That is to say, the straightening plates 36*a*, 40*a*, 42*a*, 44*a*, and 54*a* are formed into a comb shape having many straightening fins 36*b*, 40*b*, 42*b*, 44*b*, and 54*b*. The air blowing direction is determined by the directions of the straightening fins 36*b*, 40*b*, 42*b*, 44*b*, and 54*b* on the straightening plates 36*a*, 40*a*, 42*a*, 44*a*, and 54*a***.

Figure 5:
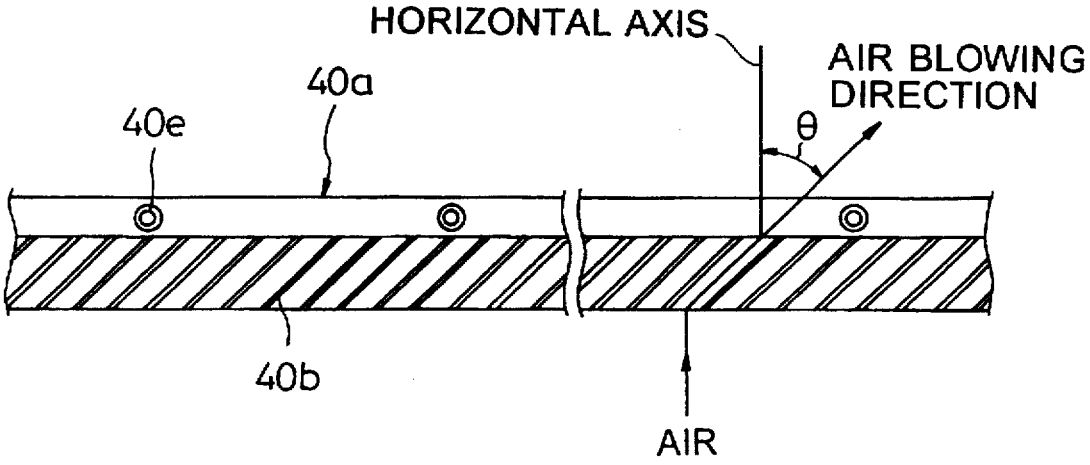
FIG. 5 is a plan view showing in detail a straightening plate shown in FIG. 4.

FIG. 5 shows a part of the straightening plate **40*a*. As shown in FIG. 5, the straightening plate 40*a* has thin (for example 1 mm) straightening fins 40*b* formed into a comb shape with predetermined intervals (for example 5 mm). Like the sideboards 58, the straightening fins 40*b* are inclined at the aforementioned predetermined angle θ toward the terminal end side of the conveyor 70 with respect to the horizontal axis perpendicular to the longitudinal axis of the belt 72, on the plan view. The straightening plate 40*a* is provided with a plurality of attaching holes 40*e*, so that the straightening plate 40*a* is fixed to the bed 38 by inserting fasteners such as bolts (denoted by reference numeral 40*f* in FIG. 6) into these attaching holes 40*e***.

Figure 6:
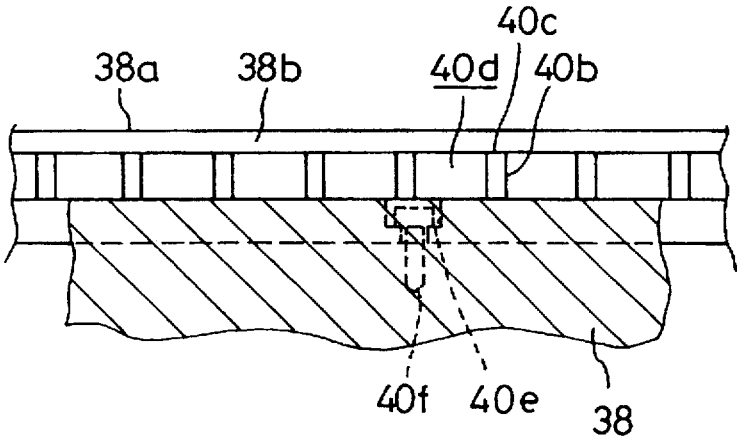
FIG. 6 is a sectional view of a bed taken along the line VI—VI of FIG. 4, showing the installation of the straightening plate.

FIG. 6 is a sectional view taken along the line VI—VI of FIG. 4. This figure shows a state in which the straightening plate **40*a* shown in FIG. 5 is attached to the bed 38. As shown in FIG. 6, the straightening plate 40*a* is attached to the bed 38 by using the bolts 40*f* with the upper end 40*c* of the straightening fin 40*b* abutting on the lower surface of a bed top plate 38*b*. The top surface of the plate 38*b* constitutes the accelerating surface 38*a*. Therefore, high-speed air supplied by the blow fan 64 flows into an air passage 40*d* defined by the adjoining straightening fins 40*b*, and then passes through the air passage 40*d*. At this time, the air is directed to a direction inclined at the aforementioned predetermined angle θ with respect to the aforementioned horizontal axis. Further, the air is blown into the shredded tobacco supply passage 35 through the air blowing opening 40 formed in the plate 38*b***.

Like the straightening plate **40*a*, each of the straightening plates 36*a*, 42*a*, 44*a*, and 54*a* has straightening fins 36*b*, 42*b*, 44*b*, and 54*b*, respectively (FIG. 4), which are formed in parallel to each other and in a direction inclined at the predetermined angle θ with respect to the aforementioned horizontal axis. The forming method, operation, and the like of the straightening fins are the same as those of the above-described straightening plate 40*a***; therefore, the explanation is omitted.

In the shredded tobacco supplying apparatus 1 having the air blowing openings 36, 40, 42, 44, and 54 constituted as described above, the direction of air blown from the air blowing opening 36 to first supply the shredded tobacco T is inclined at the predetermined angle θ with respect to the aforementioned horizontal axis (indicated by outline type arrows in the FIG. 4). Therefore, the shredded tobacco T reaching the air blowing opening 36 by dropping by gravity through the second chute 34 is sent by being deflected at the predetermined angle θ from the beginning throughout the whole region of air blowing opening 36, as indicated by solid line arrows, by the air injected from the air blowing opening 36.

The shredded tobacco T delivered by the air from the air blowing opening 36 is further accelerated in the same direction by the air injected from the air blowing openings 40 and 42 through which air is blown in a direction inclined at the predetermined angle θ (the length of the solid line arrow indicates the accelerated velocity). Finally, the shredded tobacco T is reliably supplied in a direction inclined at the predetermined angle θ toward the conveyor terminal end side with respect to the aforementioned horizontal axis by the air blown from the air blowing opening 44, and discharged toward the surface of the tobacco band 72 of the belt conveyor 70 in this state.

The air injected from the air blowing opening 54 is also blown by being deflected at the predetermined angle θ, so that the shredded tobacco T which drops through the third chute 46 and is returned onto the accelerating surface 38*a* of the bed 38 through the throat 52 is also sent by being deflected at the predetermined angle θ.

As described above, the blowing velocity $V_a$ of the air supplied from the blow fan 64 is changed according to the production volume of cigarettes, that is, the belt running speed $V_C$ of the belt conveyor 70. More specifically, the output of the blow fan 64, that is, the air blowing velocity $V_a$ is regulated so that the component $V_{THL}$ in the belt running direction of the discharge velocity $V_T$ of the shredded tobacco T discharged from the supplying apparatus 1 approaches the belt running speed $V_C$.

The air blowing velocity feedback control carried out by the main controller (blowing velocity control means) 110 will be described below.

Figure 7:
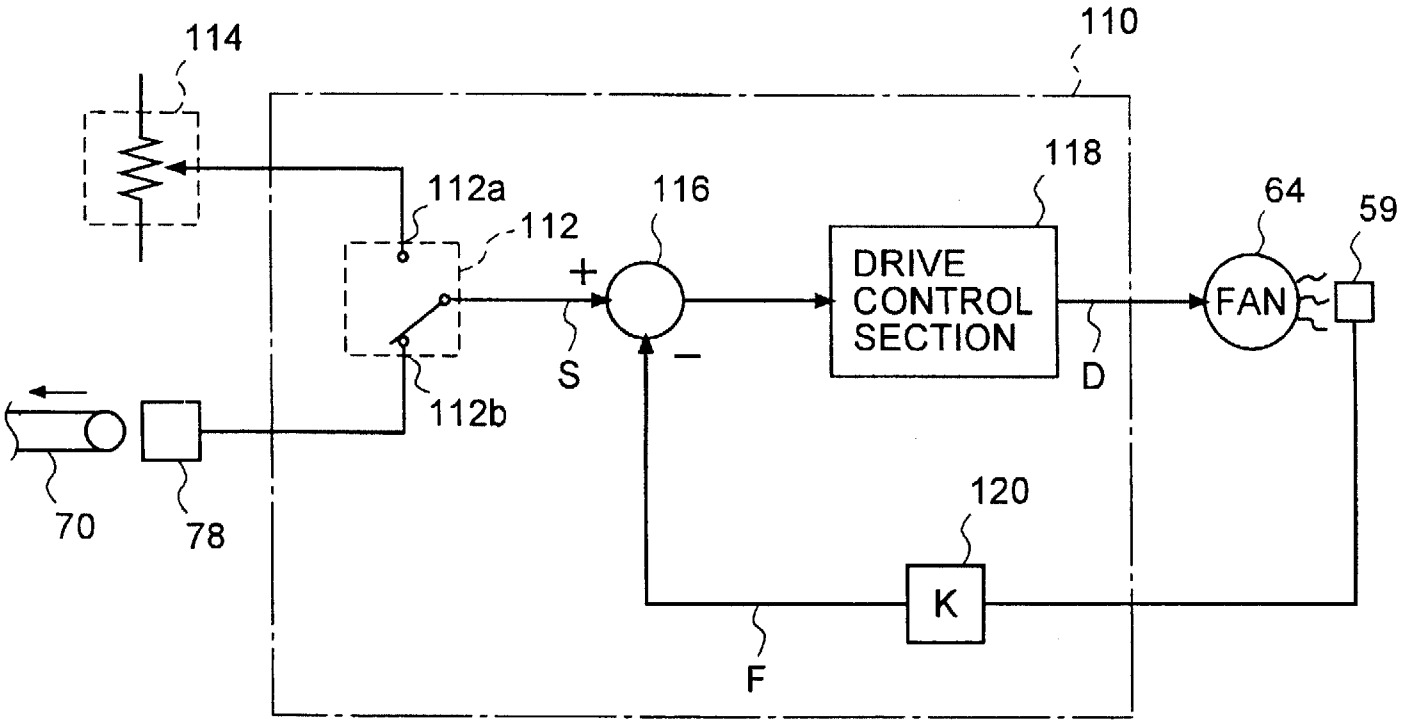
FIG. 7 is a block diagram showing an air blowing velocity feedback control function of a main controller shown in FIG. 3.

In connection with the air blowing velocity feedback control, the main controller 110 is constituted so as to perform functions shown by the blocks 112, 116, 118, and 120 in FIG. 7. In FIG. 7, reference numeral 112 denotes a change-over switch having fixed contacts 112*a* and 112*b* and a moving contact. The fixed contact 112*a* is connected to a signal generator 114, which produces a signal indicative of a lower-limit belt running speed $V_{C1}$ (for example 7.9 m/sec) in cigarette manufacturing. The fixed contact 112*b* is connected to the running speed sensor 78, which produces a signal indicative of the actual belt running speed. The moving contact operates in accordance with the result of comparison between the output signal of the signal generator 114 and the output signal of the running speed sensor 78.

Specifically, until the actual belt running speed $V_C$ reaches a predetermined speed $V_{C1}$, the moving contact is connected to the fixed contact 112*a*. In this case, the signal S0 corresponding to the predetermined speed $V_{C1}$ is supplied from the signal generator 114 to an arithmetic operation section 116 via the change-over switch 112. When the belt running speed $V_C$ exceeds the predetermined speed $V_{C1}$, the moving contact is connected to the fixed contact 112*b* as shown in FIG. 7, by which a signal indicative of the actual belt running speed $V_C$ is supplied from the running speed sensor 78 to the arithmetic operation section 116 via the change-over switch 112.

The belt conveyor operation at a speed below the aforementioned lower-limit belt running speed $V_{C1}$ is performed, for example, in the preparatory operation of the cigarette manufacturing machine before the start of cigarette production. During the cigarette production, the belt conveyor 70 is run at a belt running speed higher than the lower-limit belt running speed $V_{C1}$.

In the arithmetic operation section 116, a feedback signal F, described in detail later, is subtracted from the output signal of the signal generator 114 or the running speed sensor 78 (hereinafter called the output signal S of the speed sensor 78, or simply the output signal S). In a drive control section 118, a drive control output D is determined on the basis of the output signal S. The blow fan 64, being operated at a rotational speed corresponding to the drive control output D, blows air at the blowing velocity $V_a$ matching the belt running speed $V_C$ (see FIG. 8).

Figure 8:
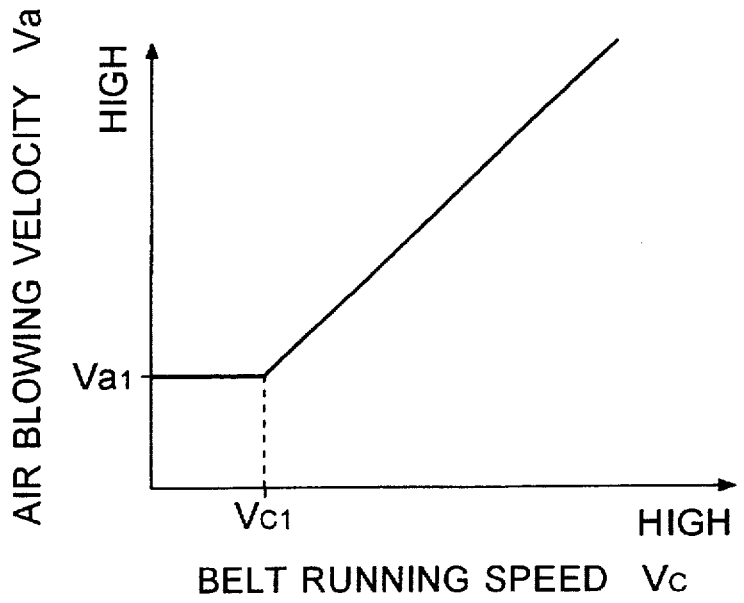
FIG. 8 is a graph showing the relationship between the running speed $V_C$ of a conveyor belt and the blowing velocity $V_a$ of air from a blow fan.

As shown in FIG. 8, when the belt running speed $V_C$ is not higher than the predetermined speed $V_{C1}$, the constant signal S0 is supplied from the signal generator 114 to the drive control section 118 via the arithmetic operation section 116. Therefore, the drive control output D supplied from the drive control section 118 to the blow fan 64 is also constant, so that the air blowing velocity $V_a$ takes a constant value $V_{a1}$.

By the operation of the blow fan 64, air is blown into the shredded tobacco supply passage 35 through the air blowing openings 36, 40, 42, 44, and 54 to produce an air flow, so that the shredded tobacco T is delivered in the supply passage 35 by the air flow, and discharged through the discharge port 43. The flow velocity of air discharged from the discharge port 43 (actual discharge velocity $V_T$ of shredded tobacco) is measured by using the airflow sensor 59. The output of the airflow sensor 59 is supplied to an arithmetic operation section 120.

In the arithmetic operation section 120, the output of the airflow sensor 59 is multiplied by a gain K, which is equal to the product of a conversion factor A and sin θ (θ is the air blowing angle) to determine the component $V_{THL'}$ ($=V_T \cdot \sin\theta$) of the actual discharge velocity $V_T$ in the belt running direction. The conversion factor A, which is a factor for compensating the detection error and the like of the airflow sensor 59, is determined by in advance experiment or the like. The feedback signal F ($=A \cdot V_T \cdot \sin\theta$) from the arithmetic operation section 120 is indicative of the actual value of the component $V_{THL'}$ of the air flow velocity (shredded tobacco discharge velocity) in the belt running direction.

As described above, the output signal S indicative of the running speed of the tobacco band 72 (belt running speed) $V_C$ is supplied from the running speed sensor 78 to the arithmetic operation section 116. This output signal S is also indicative of the target value of the component $V_{THL'}$ (air blowing velocity) of shredded tobacco discharge velocity $V_T$ in the belt running direction. On the other hand, the feedback signal F is indicative of the actual value of the velocity component $V_{THL'}$ of shredded tobacco in the belt running direction. The arithmetic operation section 116 generates a signal indicative of the difference between the output signal S and the feedback signal F, that is, the difference between the target value and the actual value of the velocity component $V_{THL'}$ of shredded tobacco in the belt running direction.

The drive control section 118 determines the drive control output D on the basis of the output signal from the arithmetic operation section 116. The drive control output D is, basically, set at a value such that the air blowing velocity $V_a$ matching the belt running speed $V_C$ can be obtained, and further set at a value such that the air blowing velocity $V_a$ at which the difference between the target value (belt running speed $V_C$) and the actual value of the velocity component $V_{THL'}$ of shredded tobacco in the belt running direction is zero can be obtained.

Figure 9:
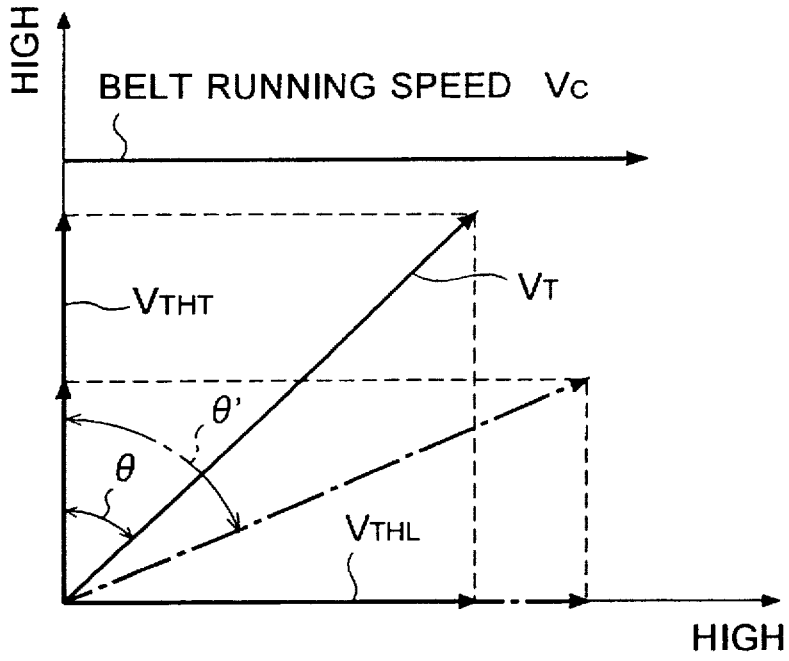
FIG. 9 is a vector diagram showing the relationship between the running speed $V_C$ of a conveyor belt and the transfer velocity $V_T$ of shredded tobacco and the velocity components $V_{THL}$ and $V_{THT}$ of shredded tobacco.

FIG. 9 is a vector diagram showing the belt running speed $V_C$ of the belt conveyor 70 when feedback control is carried out, the transfer velocity $V_T$ of shredded tobacco, and velocity components (velocity component in the belt running direction (a first horizontal velocity component) $V_{THL}$ and a second horizontal velocity component $V_{THT}$ in the direction perpendicular to the first horizontal velocity component) of shredded tobacco.

In this embodiment having the shredded tobacco supply passage 35 curved upward in a concave form, the second horizontal velocity component $V_{THT}$ in the direction perpendicular to the longitudinal axis of the belt 72 decreases on the side of the supply passage outlet 43. The vertically upward velocity component increases on the side of the supply passage outlet. The first horizontal velocity component $V_{THL}$ scarcely changes from the inlet to the outlet of supply passage, if the transfer velocity of shredded tobacco remains constant from the inlet to the outlet of the supply passage.

When the feedback control of the air blowing velocity $V_a$ is carried out as described above, the shredded tobacco T is discharged from the discharge port 43 at the discharge velocity $V_T$ corresponding to the air blowing velocity $V_a$. The shredded tobacco T is discharged in the direction inclined at the predetermined angle θ (for example 45 deg) toward the terminal end side of the conveyor 70 with respect to the horizontal axis perpendicular to the longitudinal axis of the belt 72, on the plan view. Therefore, as shown in FIG. 9, the shredded tobacco T always has the velocity component $V_{THL'}$ (=$V_{THL}$) in the belt running direction close to the belt running speed $V_C$. That is to say, the difference in relative speed between the shredded tobacco T and the tobacco band 72 can be kept small. Therefore, even if the belt running speed $V_C$ changes, the shredded tobacco T is attracted to the surface of the tobacco band 72 of the belt conveyor 70 smoothly and properly. It is essentially desirable that the belt running speed $V_C$ agree with the velocity component $V_{THL'}$ of shredded tobacco discharge velocity $V_T$ in the belt running direction. Also, on the vertical sectional view, the shredded tobacco T is discharged in the upward direction at an angle to the horizontal plane. Therefore, the shredded tobacco T has a vertically upward velocity component.

During the feedback control of air blowing velocity, the running speed of the finned conveyor 22 is also controlled in accordance with the belt running speed $V_C$, so that a proper amount of shredded tobacco T is supplied to the accelerating region 35.

Also, the attracting force of the suction fan 76 is controlled properly in conformity with the feedback control of air blowing velocity $V_a$. Specifically, the attracting force of the suction fan 76 is changed so that the vertically upward velocity component of shredded tobacco at the supply passage outlet 43 agrees with the velocity of shredded tobacco attracted by the suction fan 76. Thereupon, the shredded tobacco T is attracted to the tobacco band 72 more reliably and stably.

As described in detail above, the blowing velocity $V_a$ of air blown from the air blowing openings 36, 40, 42, 44, and 54 in the direction inclined at the predetermined angle θ toward the terminal end side of the conveyor 70 with respect to the horizontal axis perpendicular to the longitudinal axis of the belt conveyor 70, on the plan view, is controlled to be a proper value in accordance with the belt running speed $V_C$, so that the shredded tobacco T discharged from the discharge port 43 is attracted to the surface of the tobacco band properly without being repelled. Therefore, the shredded tobacco supplying apparatus 1 can always supply a constant, stable amount of shredded tobacco T continuously to the wrapping machine 2. As a result, the amount of shredded tobacco T enveloped in the paper P is always constant, by which the degradation in the quality of cigarettes can be prevented.

The present invention is not limited to the above embodiment, but can be modified variously.

For example, in the above-described embodiment, the attaching angles of the straightening fins **36*b*, 40*b*, 42*b*, 44*b*, and 54*b* on the straightening plates 36*a*, 40*a*, 42*a*, 44*a*, and 54*a* mounted at the air blowing openings 36, 40, 42, 44, and 54**, respectively, are fixed to the predetermined angle θ (for example 45 deg). Alternatively, the attaching angle of the straightening fin may be changed from the predetermined angle θ according to the production volume of cigarettes, that is, the belt running speed $V_C$.

When the belt running speed $V_C$ is greatly increased to vastly increase the production volume of cigarettes, for example, the straightening plate is replaced with one having straightening fins with a large attaching angle so that the magnitude of the velocity component $V_{THL}$ in the belt running direction of shredded tobacco T approaches the magnitude of the belt running speed $V_C$. If the attaching angle of straightening fin is thus increased to a large angle (denoted by reference character θ' in FIG. 9), even at the same air blowing velocity $V_a$, the velocity component $V_{THL}$ of shredded tobacco T in the belt running direction can be close to the belt running speed $V_C$ (indicated by the on-dotted chain line in FIG. 9). In this case, preferably, the attaching angle of the sideboard 58 defining the shredded tobacco supply passage 35 is also changed.

In the above-described embodiment, all attaching angles of the straightening fins on the straightening plates **36*a*, 40*a*, 42*a*, 44*a*, and 54*a* have been set at the same angle θ (for example 45 deg), but the constitution is not limited to this. The angle θ may be increased gradually from the most upstream air blowing opening 36. For example, in the case of a modification shown in FIG. 10, the attaching angles of the straightening fins 36*b*, 54*b*, 40*b*, 42*b*, and 44*b* on the straightening plates 36*a*, 54*a*, 40*a*, 42*a*, and 44*a* are set at θ1, θ2, θ3, θ4, and θ5 (θ1<θ2<θ3 <θ4<θ5<90 deg), respectively. These angles θ1, θ2, θ3, θ4, and θ5 have sequentially increasing values from angle θ1 to angle θ5 with a predetermined change rate. At this time, the sideboard 58 forming the shredded tobacco supply passage 35** is curved smoothly so as to match the change in the straightening fin attaching angle from θ1 to θ5.

Figure 10:
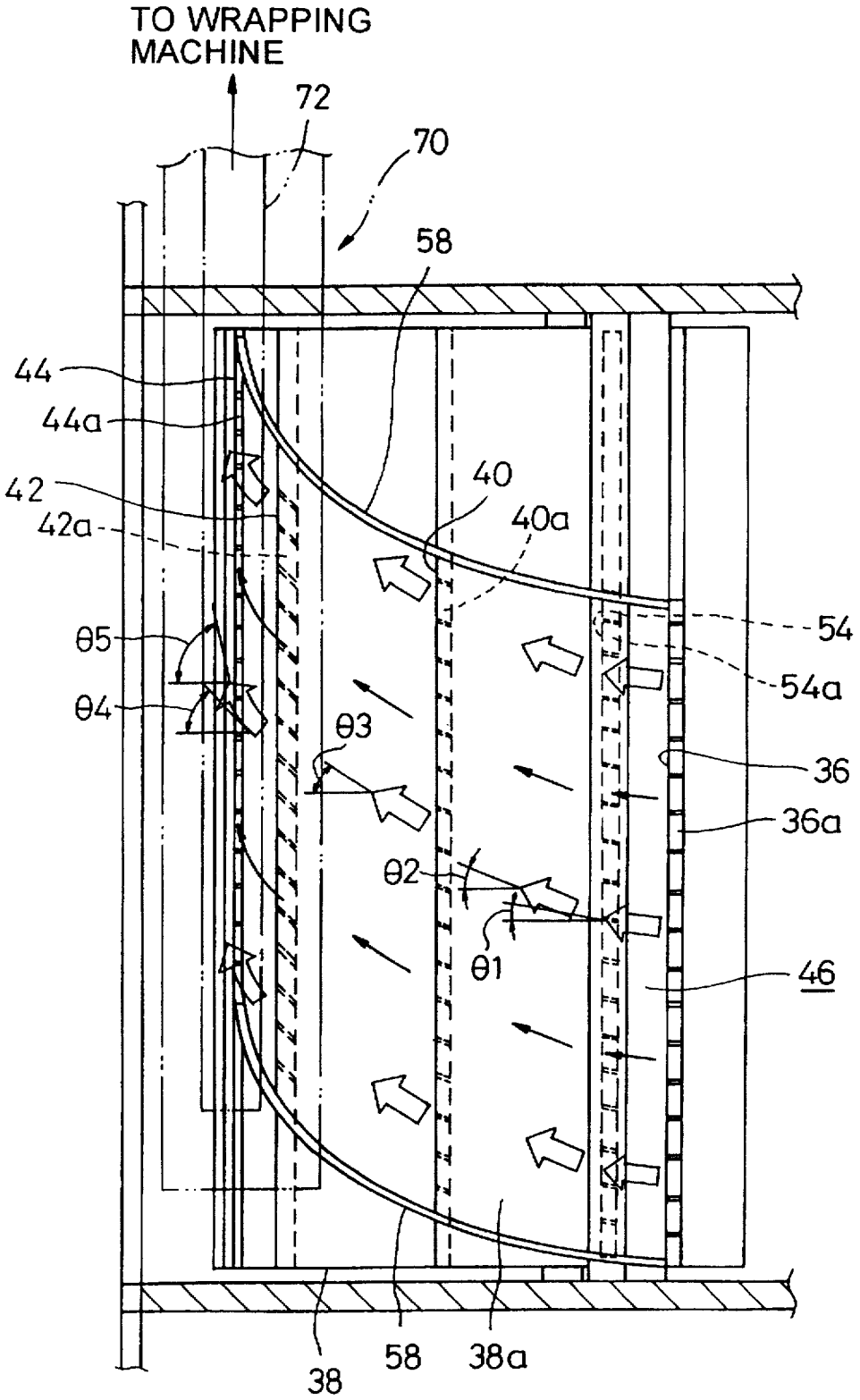
FIG. 10 is a transverse sectional view of a shredded tobacco supplying apparatus in accordance with a modification of the present invention, taken along the line IV—IV of FIG. 3.

If the air blowing angle is increased gradually so that the angle at which air is blown from the air blowing opening becomes larger on the downstream side of the shredded tobacco supply passage 35, even when the length of the bed is limited and the total length cannot be increased, as shown in FIG. 10, the final magnitude of the velocity component $V_{THL}$ in the belt running direction of shredded tobacco T can satisfactorily be close to the magnitude of the belt running speed $V_C$.

In this case, if the change rate of straightening fin attaching angle is changed from the above-described modification, and the attaching angle of the most downstream straightening fin **44*b* is made larger than angle θ5, the velocity component $V_{THL}$ of shredded tobacco T in the belt running direction can be increased within the limited total length of the bed 38, and the velocity component of shredded tobacco T in the direction perpendicular to the longitudinal axis of belt, on the plan view, can be decreased, by which the breakage of shredded tobacco T due to the collision with the tobacco band 72** can be prevented properly.

The vertically upward velocity component shredded tobacco T can be changed appropriately by changing the air blowing angle with respect to the horizontal plane.

In the above-described embodiment, the straightening plate is replaced to change the attaching angle θ of straightening fin. Alternatively, the straightening fin may be provided with a manual or actuator-driven rotating means for freely changing angle θ to change the direction of straightening fin. For example, a plurality of straightening fins are rotatably mounted on the straightening plate, and the straightening fins are rotatably connected by means of one rod extending in the longitudinal direction of straightening plate. Further, a guide member for slidably guiding the rod and a lock member for locking the slide position of rod are provided. When the straightening fin angle is changed, the lock of rod is released, the rod is slid to the slide position corresponding to a desired straightening fin angle manually or by using an actuator operated under control of the main controller 110, and then the rod is locked to that slide position.

Also, in the above-described embodiment, five air blowing openings 36, 40, 42, 44, and 54 are provided in the air blowing regions. However, any number of air blowing openings may be used. For example, the air blowing openings 36 and 54 are left as they are, and the number of the air blowing openings on the bed 38 may be changed. Further, the arrangement of the air blowing openings is not limited to the arrangement shown in the above-described embodiment. The air blowing openings may be arranged at positions suitable for supplying the shredded tobacco with air.

In the above embodiment, the shredded tobacco supplying apparatus 1, which has the bed 38 forming the supply passage 35 extending from the lateral side of the conveyor 70 toward the belt 72, and supplies the shredded tobacco with air while accelerating the shredded tobacco on the accelerating surface (supply surface) 38*a*, has been described in detail. However, the present invention is not limited to this embodiment. A supplying apparatus, if having air-supplying means, may be used, which has a shredded tobacco supply passage (chimney) extending along the longitudinal axis of conveyor toward the tobacco band 72, in place of the bed 38. The supplying apparatus of this type can also achieve the same effect satisfactorily.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

What is claimed is:

1. A shredded tobacco supplying apparatus for a cigarette manufacturing machine, which continuously manufactures a cigarette rod by enveloping shredded tobacco supplied onto a paper, comprising:

a conveyor, having a belt with a surface to which shredded tobacco can be attracted, for conveying shredded tobacco, attracted in layers to said belt surface, to said paper by running said belt;

air-supplying means, having a supply passage extending below said conveyor toward said belt surface, for producing an air flow by blowing air from at least one air blowing region provided in said supply passage into said supply passage and for supplying said shredded tobacco toward said belt surface by using said air flow:

running speed detecting means for detecting a change in running speed of said belt; and blowing velocity control means for driving said air-supplying means so that the blowing velocity of air from said air blowing region changes in accordance with the change in the belt running speed detected by said running speed detecting means.

2. The shredded tobacco supplying apparatus according to claim 1, wherein said air-supplying means has a supply surface defining one side of said supply passage, and said supply surface is curved upward in a concave form.

3. The shredded tobacco supplying apparatus according to claim 1, wherein said belt has a longitudinal axis extending parallel to a traveling direction of said belt, said supply passage of said air-supplying means extends from a lateral side of said conveyor toward said belt surface, and said air-supplying means blows air into said supply passage in a direction inclined at an acute angle with respect to said longitudinal axis of said belt.

4. The shredded tobacco supplying apparatus according to claim 1, wherein said blowing velocity control means includes means for driving said air-supplying means so that the blowing velocity of the air changes in such a manner that a velocity component in a belt running direction given to the shredded tobacco by the air follows the belt running speed.

5. The shredded tobacco supplying apparatus according to claim 1, wherein said air-supplying means includes means for changing a direction of airflow in accordance with the belt running speed.

6. The shredded tobacco supplying apparatus according to claim 1, wherein said supplying apparatus further comprises attracting means for producing an attracting force for attracting the shredded tobacco to said belt surface, said attracting means including means for changing the attracting force in accordance with the blowing velocity of the air.

7. The shredded tobacco supplying apparatus according to claim 1, further comprising a change-over switch for selectively switching an input signal being provided to said blowing velocity control means between a signal provided by said running speed detecting means and a signal provided by a signal generator indicative of a belt speed lower limit.

* * * * *